US009624745B2

(12) United States Patent
Sørbø et al.

(10) Patent No.: US 9,624,745 B2
(45) Date of Patent: Apr. 18, 2017

(54) DOWNHOLE UMBILICAL RELEASE ASSEMBLY

(71) Applicant: Oil Tools of Norway, Randaberg (NO)

(72) Inventors: Espen Sørbø, Randaberg (NO); Tommy Lofthus, Stavanger (NO)

(73) Assignee: Oil Tools of Norway, Randaberg (NO)

( * ) Notice: Subject to any disclaimer, the term of this patent is extended or adjusted under 35 U.S.C. 154(b) by 0 days.

(21) Appl. No.: 14/900,911

(22) PCT Filed: Jun. 27, 2014

(86) PCT No.: PCT/EP2014/063698

§ 371 (c)(1),
(2) Date: Dec. 22, 2015

(87) PCT Pub. No.: WO2014/207204

PCT Pub. Date: Dec. 31, 2014

(65) Prior Publication Data

US 2016/0138354 A1 May 19, 2016

(30) Foreign Application Priority Data

Jun. 28, 2013 (GB) ..... 1311696.7
Jun. 28, 2013 (NO) ..... 20130899

(51) Int. Cl.
*E21B 29/04* (2006.01)
*E21B 29/08* (2006.01)
*E21B 29/06* (2006.01)

(52) U.S. Cl.
CPC ..... *E21B 29/04* (2013.01); *E21B 29/08* (2013.01); *E21B 29/06* (2013.01)

(58) Field of Classification Search
CPC ..... E21B 29/04; E21B 29/08; E21B 17/026; E21B 29/06
See application file for complete search history.

(56) References Cited

U.S. PATENT DOCUMENTS 745,526 A 12/1903 Rogers et al.
4,160,478 A * 7/1979 Calhoun ..... E21B 29/04 166/319

(Continued)

FOREIGN PATENT DOCUMENTS

GB 2237592 A 5/1991
GB 2497607 A 6/2013

(Continued)

OTHER PUBLICATIONS

International Search Report and Written Opinion dated Mar. 4, 2015 for International Application Serial No. PCT/EP2014/063698, International Filing Date: Jun. 27, 2014, consisting of 12 pages.

(Continued)

*Primary Examiner* — Daniel P Stephenson
(74) *Attorney, Agent, or Firm* — Christopher & Weisberg, P.A.

(57) ABSTRACT

There is provided a downhole umbilical release assembly comprising a guillotine arrangement provided by a guillotine alignment sub (12) and a guillotine mandrel (16). The guillotine alignment sub has a first edge (27) over which an umbilical is positioned in a wellbore string. The guillotine mandrel is positioned radially outwardly of the guillotine alignment sub and is arranged to move longitudinally with respect thereto. The guillotine mandrel has a second edge (29) that is arranged to pass over the first edge (27) of the guillotine alignment sub during longitudinal movement of the guillotine mandrel relative to the guillotine alignment sub. This severs an umbilical positioned between the two edges (27,29).

18 Claims, 8 Drawing Sheets

(56) References Cited

U.S. PATENT DOCUMENTS

| | | | | |
|---|---|---|---|---|
| 4,427,059 | A | 1/1984 | Olivier | |
| 4,653,776 | A | 3/1987 | Borg | |
| 4,660,635 | A * | 4/1987 | Wittrisch | E21B 17/025 166/156 |
| 6,789,627 | B2 * | 9/2004 | Leismer | E21B 29/04 166/117 |
| 6,997,262 | B2 * | 2/2006 | Palmer | E21B 29/04 166/298 |
| 2005/0006102 | A1 | 1/2005 | Cho | |
| 2010/0294477 | A1 | 11/2010 | Zavesky et al. | |

FOREIGN PATENT DOCUMENTS

| | | | | |
|---|---|---|---|---|
| NO | WO 2014207204 | A2 * | 12/2014 | E21B 29/04 |
| WO | 00/26496 | A1 | 5/2000 | |
| WO | 01/88330 | A1 | 11/2001 | |
| WO | 2004/011768 | A1 | 2/2004 | |

OTHER PUBLICATIONS

Norwegian Search Report dated Jan. 23, 2014 for corresponding Norwegian Application Serial No. 20130899, Norwegian Filing Date: Jun. 28, 2013, consisting of 2 pages.

United Kingdom Search Report dated Dec. 17, 2013 for corresponding United Kingdom Application Serial No. GB1311696.7, United Kingdom Filing Date: Jun. 28, 2013, consisting of 3 pages.

International Preliminary Report dated Jan. 7, 2016 for International Application Serial No. PCT/EP2014/063698, International Filing Date: Jun. 27, 2014, consisting of 10 pages.

* cited by examiner

DOWNHOLE UMBILICAL RELEASE ASSEMBLY

CROSS-REFERENCE TO RELATED APPLICATIONS

This application is a Submission under 35 U.S.C. §371 for U.S. National Stage Patent Application of, and claims priority to, International Application Number PCT/EP2014/063698, filed Jun. 27, 2014, entitled "DOWNHOLE UMBILICAL RELEASE ASSEMBLY", which is related to and claims priority to Norwegian Patent Number NO 336539, filed Jun. 28, 2013, and is also related to and claims priority to Great Britain Application Number GB 1311696.7, filed Jun. 28, 2013, the entire contents of each of which are hereby incorporated herein by reference.

TECHNICAL FIELD

The invention relates to an apparatus for releasing a downhole umbilical, and to a corresponding method of releasing a downhole umbilical.

INTRODUCTION

Under some circumstances, for example during workover of an oil and gas well, cutting and retrieval of the drilling or production tubing may be required. In many wells, in particular those on the Norwegian Continental Shelf (NCS), downhole umbilicals (e.g., control lines) are hooked up to downhole equipment for power supply, communication between surface and a downhole control unit, and/or for monitoring the equipment downhole. If it is necessary to cut and retrieve part of the drilling or production string it is also necessary to cut the umbilicals. While the cutting location on the tubing is well defined, it is difficult to control where the umbilical is cut. Excess umbilical left in the wellbore above the production tubing cut may hinder later operations downhole, for example towards the borehole assembly (BHA), and tedious and time-consuming operations to clear the wellbore of excess downhole umbilical may be required.

There are several known solutions to address the problem of controlled release of the downhole umbilicals.

For example, clamps have been devised to keep the umbilical tight against the outer diameter of the production tubing at the proposed cutting zone of the production tubing. This has the effect that the umbilicals are cut as the production tubing is cut. However, this solution limits the length of the cutting zone of the production tubing, leaves uncertainty as to the ability of cutting the umbilical at the same time as the tubing, and creates the risk of damaging the inner diameter of the outside casing when cutting through the production tubing, which may be eccentrically placed inside the casing.

Special machined clamps that require stripping of plastic and bumper bars from umbilicals have also been considered. The uncertainty is less than with the above described solution, but production tubing cutting zone is limited significantly, installation time is increased, and this weaker "cutting area" can compromise downhole completion system integrity.

Further, other cutting sources for production tubing, such as explosives and plasma, have been found to be unsuitable for cutting umbilicals as among other factors, the result is too unreliable and/or unpredictable.

Pre-made weak points for the umbilical may be broken during deployment of the completion system, and are thus not recommended.

Dedicated tools for cutting the umbilicals which are located on/in the tubing string have also been developed.

For example, slotted cutting subs for retaining umbilicals within the sub have been considered. With this arrangement the umbilicals are held tight to a dedicated special sub. However, special cutting tools need to be developed in order to cut extremely heavy wall tubing, and this solution also impedes the use of running overshot assemblies and limits wireline entry below cut production tubing.

A dedicated cutter body attachable (for example, clamped) to the piping is described in U.S. Pat. No. 6,997,262. This tool encloses the umbilical, to which there are fixedly attached (for example, clamped) longitudinal sliding cutter knives. After cutting of the drilling or production tubing, when pulling the upper part of piping together with the cutter body, the knives slide along an actuating surface towards an abutting surface of the moving cutter body and cut the umbilical.

This solution requires a dedicated cutting body fixedly attached to the tubing string. Further, the umbilical is cut above the tubing cutting location, thus leaving a segment of the umbilical lines dangling in a location which may disturb later downhole operations. The cutting body follows the upper part of piping, and is pulled out with the piping string.

WO-A-2010/135490 describes an improved dedicated cutting body design which allows cutting of the umbilical below the cut point of the production tubing. The cutting body remains in the well, cleanly trapping the umbilical segments remaining in the well. This allows the umbilical part to remain downhole contained in the cutting body, thus avoiding free dangling umbilical which may hinder subsequent operations.

In WO-A-2011/082146 various combinations and improvements to the above dedicated cutting body designs are described. These dedicated cutting body solutions, while they offer many advantages over the prior art, have a certain number of drawbacks. For example, a separate cutter body is required for each umbilical to be cut and so, if multiple umbilicals are to be cut, the solution becomes cumbersome and requires excessive installation time on deck. Further, different cutting body constructions are required for different sizes of umbilicals. Through the cutting body remaining downhole, the remaining head downhole is not a standard pipe size, and this limits well rework with standard tools and methods. Flatpacks, which are umbilicals having a flatter or substantially oval form compared to the more traditional cylindrical umbilicals, are not protected mechanically by the assembly, which exposes them to risk of being damaged. In addition, as cutting is triggered by a relative sliding between the umbilical and the tubing, this solution risks accidental cutting should the umbilical get hooked on its way down during deployment. Robustness of the design is also limited by the fact that there are many pieces, of which several are moving ones.

Another dedicated control line cutting tool is described in U.S. Pat. No. 7,128,155. This tool is installed as part of the pipeline, and after being cut at a designated cutting target zone, the tool is guided by a helical sleeve to cut the control line by rotation at a level below the top end of the pipe remaining downhole. This solution also has a certain number of drawbacks. Firstly, a flatpack cannot be installed on such a tool with a cylindrical housing without having a termination close to the tool. Often, such a cutting assembly is installed above and not far from the production packer, but at a distance typically longer than 10 or even 50 meters. Given the closed cylindrical housing, and because sliding 10 to 50 m of flatpack in the tool housing on deck when building the production string is a demanding and time-consuming task, such a tool can probably not be installed without any proximate flatpack termination. As a consequence, this prior art tool cannot be installed at other locations than right above the production packer. In addition, this cutting tool either does not leave much room for several umbilical lines (concentric design), or will require a large diameter for the tool (eccentric design).

There is, therefore, a desire to provide an improved assembly and method for releasing an umbilical downhole.

SUMMARY OF THE INVENTION

In a first aspect there is provided a downhole umbilical release assembly comprising: a guillotine alignment sub, the guillotine alignment sub having a first edge over which an installed umbilical would be positioned, and a guillotine mandrel positioned radially outwardly of the guillotine alignment sub and arranged to move longitudinally with respect thereto, the guillotine mandrel comprising a second edge that is arranged to pass over the first edge of the guillotine alignment sub during longitudinal movement of the guillotine mandrel relative to the guillotine alignment sub to sever an installed umbilical.

As the umbilical is severed by action of relative longitudinal movement of the first and second edges of the guillotine alignment sub and guillotine mandrel, a simple cutting assembly, with minimal parts can be provided. The umbilical may be released by being cut by a guillotine action between the first and second edges. As the number of parts, and in particular moving parts, is minimised, the robustness of the system is increased. Additionally, the installation of the assembly can be made easier and faster, minimising rig stoppage time and making production of the assembly more cost effective. A much simpler installation also provides benefits in terms of minimising the time that workers need to be in the red zone of a rig.

The first edge may be arranged parallel to the second edge. In this way, the edges of the guillotine mandrel and the guillotine alignment sub perform a chopping action to sever the one or more umbilicals present between the two edges. The first and second edges may be arranged in a transverse (parallel to the circumference) direction where they lie in a plane perpendicular to the longitudinal axis of the string, or the first and second edges may be arranged parallel to one another and lie in a plane that is inclined to the longitudinal axis, for example, an angle of greater than 1 degree up to an angle of, say, 45 degrees. Such edges may also be parallel and follow a curved path, rather than lie in a plane, where the curved path is inclined to the longitudinal axis, at least for some of its length.

In another embodiment, the first edge and the second edge are angled with respect to each other. Where more than one umbilical is present to be released, this may allow them to be cut sequentially (this including the possibility where cutting is started on one before a previous one has been fully severed). This can reduce the loads required during cutting of the umbilicals and the spring back of the components, making the cutting operation more reliable.

The relative angle between the two edges (i.e., the angle seen enclosed by the two edges when viewing the assembly in a radial direction directly at the edges) may be arranged so that a first umbilical is completely severed before the assembly starts to sever the next umbilical, i.e., the relative angle between the edges may be a function of the width of the umbilicals to be severed.

The relative angle between the first edge and the second edge may be between 5 and 85 degrees. In one embodiment the first and second edge are angled at 20 degrees or more to one another, more preferably 30 degrees or greater. The relative angle between the first and second edges may be up to 70 degrees or less, more preferably 60 degrees or less. In a certain embodiment the relative angle between the first and second edges is about 45 degrees (± up to 5 degrees).

In another embodiment, the relative angle between the first and second edges may be up to about 45 degrees (± up to 5 degrees), i.e., between 0 and 45 degrees. More preferably the relative angle is between 15 and 30 degrees, for example about 22.5 degrees.

It has been found that the greater the angle between the first edge and the second edge the less the shear force required to cut an umbilical(s) installed in the assembly. However, the distance over which the guillotine has to travel to completely sever the umbilical(s) is greater when the angle between the edges is greater and the stretch of the umbilical(s) during cutting is greater. This may result in a less clean cut of the umbilical(s). The optimum angle between the cutting surfaces may therefore depend on whether it is desired to have a lower cutting force or a cleaner cut performed over a shorter distance, and this to an extent may also depend on the type of umbilical being cut.

In an embodiment, the first edge or the second edge may extend in a substantially transverse direction, i.e., in a direction parallel to the circumference of the assembly. When there is a relative angle between the two edges, one of the edges, for example, the first edge of the guillotine alignment sub, may be parallel to the circumferential direction and the other edge (in this example, the second edge of the guillotine mandrel) may be offset relative to the circumferential direction.

When the first and second edges are inclined relative to one another, the first and/or second edges may follow the cylindrical curvature of the assembly, i.e., share the same axis as the other components for their radii of curvature. These first and/or second edges may appear linear when the assembly is viewed in a radial direction, e.g. the first edge may appear to extend as a straight line that follows a circumferential path and the second edge may follow a portion of a helical path inclining at a steady pitch.

In some instances it may be desirable for one of the edges or both of the edges to be curved in the longitudinal direction relative to the other, so that the intensity of the cutting action (which is a function of the relative angle between the two edges at the point where they cross) varies with respect to the cutting position as the two edges pass over one another. The first and/or second edge may also include serrations.

The first and/or second edges may be referred to as cutting edges. This is because the action of the two edges moving past each other causes cutting of the umbilical(s) positioned therebetween. They may be provided by a right-angled edge of the guillotine mandrel and/or the guillotine alignment sub, for example. Due to the nature of the assembly, it is not usually necessary for the edges to feel sharp (and indeed they might appear quite blunt) in order to be able to sever the umbilical(s). An advantage of this assembly is that the need for sharp edges can be avoided, thereby offering improved safety for the workers installing the assembly. The edge need not be provided as a right-angle but may be formed with a profile where the angle of the surfaces forming the edge come together at less than 90 degrees. The edges can have different cross-sectional profiles. A cutting edge may also be provided by a separate blade, perhaps made from a higher performance material, that is attached to a surface of the guillotine mandrel or guillotine alignment sub to perform the cutting action.

The assembly may be arranged so that when the second edge passes over the first edge, the movement is controlled so that there is a fine tolerance in the separation of the edges. For example, the radial distance between the first edge and the second edge may be less than 5 mm, possibly less than 2 mm, perhaps even less than 1 mm or 0.5 mm. In one arrangement the radial distance may be 0 mm, in other words the second edge may be arranged to slide over and be in direct contact with the first edge and the outer periphery of the guillotine alignment sub. By controlling the separation and keeping it within a fine tolerance, the action of the edges passing over each other can cause the installed umbilical(s) to be severed reliably.

The assembly may comprise a guide clamp assembly which is arranged to clamp a well end of the umbilical in position. In an embodiment, the guide clamp assembly is arranged to clamp the umbilical to the guillotine alignment sub on a well side of the first edge. This means that after the umbilical has been severed by the assembly, it is held in a given position on a well zone of the cut point (the term "cut point" here is referring to the point where the tubing is cut). This can aid the recovery operations of the drilling or completion string and make them easier and faster.

The assembly may also comprise an umbilical support device which attaches the umbilical(s) to the assembly on the rig side of the cut point. This is so the part of the umbilical on the rig side of the cut point is held in position and can be retrieved with the top part of the assembly.

The assembly may comprise guide formations which guide the longitudinal movement of the guillotine mandrel relative to the guillotine alignment sub. This ensures that the first and second edges are suitability located relative to each other as they pass over each other to cause the severing of the umbilical(s). The guide formations may be provided in part by the guide clamp assembly.

For example, the guide formations may be provided by one or more guide members (e.g., protrusion or protrusions) on the guide clamp assembly and/or the guillotine mandrel, these guide formations being received in a guide slot on the other of the guide clamp assembly and/or the guillotine mandrel. The guide slot may be formed in an inner or outer surface of one of the members. An advantage of the guide slot being provided in an outer surface of one of the components is that machining the component to form the guide slot is easier and the tolerance on machining the parts is less critical.

The guide members may extend in an axial direction, i.e. in a direction from the rig end to the well end or vice versa depending on which component the guide member is located.

The guide member(s) may be arranged such that it is received by the guide channel(s) at least until the second edge has passed over the first edge, such that the second edge is on a rig side of the first edge. For example, the guide member may be longer than the longitudinal separation between the first and second edges when the guillotine mandrel is in its most downhole position. This means that the guide member will continue to guide the movement of the guillotine mandrel until after the umbilical has been severed. This helps to ensure that the umbilical can be reliably severed. The guide member(s) may become fully withdrawn from the guide channel(s) after the umbilical(s) have been severed.

The guide channel and guide member may act to prevent relative rotation between the guillotine mandrel and the guillotine alignment sub and may also help to prevent deflection in the radial direction of the guillotine mandrel with respect to the guillotine alignment sub. This ensures that the edges are in the correct position to sever the umbilical as they pass over each other in the longitudinal direction of the assembly.

In an embodiment, the guide clamp assembly comprises a guide channel in the form of a guide slot (more preferably a pair of guide slots) for guiding the longitudinal movement of the guillotine mandrel. When the guide clamp assembly comprises a guide slot, the guillotine mandrel may comprise a guide part/member, for example, a guide member which extends longitudinally and is arranged to be received by the guide slot of the guide clamp assembly. The guide part may comprise a pair of longitudinally extending 'wings' or guide members. Such an arrangement, where the guide members of the pair are arranged on either side of the umbilical is useful to balance the weight distribution about the longitudinal axis in addition to balancing the torsional forces.

In another embodiment, the guide member(s) may be provided on the guide clamp assembly. The one or more guide members may be received in a guide channel, such as a slot or recess on or in the guillotine mandrel.

Additionally or alternatively to the above embodiments, the guide formations may comprise a guillotine support clamp which holds the guillotine mandrel radially relative to the guillotine alignment sub.

In an embodiment, the guillotine mandrel is joined to a load mandrel to provide an outer assembly that can be moved longitudinally with respect to the guillotine alignment sub.

The load mandrel may be used to transmit longitudinal force to the guillotine mandrel to cause it to move in a longitudinal direction relative to the guillotine alignment sub when the top part of the assembly (i.e., the rig side part of the assembly) is pulled up rig side.

The guillotine mandrel may comprise a substantially semi-cylindrical form. It may further comprise longitudinally extending edges which are bolted to respective longitudinally extending edges of the load mandrel. This provides a good interface between the guillotine mandrel and the load mandrel so that force can be transmitted reliably. It also provides an easy way of joining the two pieces. These longitudinally extending edges may be provided at 180 degree positions on the respective guillotine mandrel and load mandrel (i.e., on opposing sides of the longitudinal axis of the assembly), to maximise the strength of the bolted connection.

In an embodiment, the load mandrel comprises a longitudinal slot. This slot is for receiving the upper portions of the umbilicals (i.e., the rig side portions) to protect them during use of the string. The provision of a slot also means that the load mandrel can be joined to the rest of the assembly before the assembly is connected up to the string, since the umbilicals are installed within the slot. This helps to reduce the time required for workers on a rig, in the red zone, to connect up the downhole umbilical release assembly to the rest of the completion string.

The slot may be an opening (if the load mandrel is a tubular member) or may be recess in the load mandrel (more than one recess may be provided where more than umbilical is used). The slot may have a depth which is greater than the thickness of the umbilical. This is so that the umbilical does not protrude from the outer diameter of the load mandrel. Flatpacks may be used to minimise the outward extension of the umbilicals and any slot may be wide enough to accommodate two or more such flatpacks.

In an embodiment the assembly comprises a main body, which in use provides a section of a completion string or other wellbore string. The main body may comprise a length of tubing which has a tubing cutting zone. As explained above in certain circumstances it may be required to cut and retrieve a portion of the drilling or production tubing. With this arrangement, the length of tubing may be cut in the tubing cutting zone and then pulled out of the well. The action of pulling the top portion of the tubing out of the wellbore causes the second edge of the guillotine mandrel to move in a longitudinal direction relative to the first edge to thereby sever an installed umbilical or umbilicals. The action of retrieving the top portion of the tubing may retrieve top side (to the extent that they are present) at least the load mandrel, the guillotine mandrel, a top sub, an upper part of the cut zone tubing and an upper part of the severed umbilical. To the extent that they are present, the guillotine alignment sub, the guide clamp assembly, a lower part of the cut tubing and a lower part of the cut umbilical may be left downhole.

The guillotine mandrel, and if present the load mandrel, may be positioned radially outwardly and around the tubing cutting zone. With this arrangement the casing wall may be protected when the tubing is being cut.

The guillotine mandrel may be coupled to the main body on a rig side of the tubing cutting zone. The coupling may be direct attachment or it may be via one or more other components, such as a load mandrel. The main body may comprise a top sub which is attached to the length of tubing at a rig end thereof. This top sub may be attached directly to the length of tubing or it may be attached to the tubing via a coupling device. In an embodiment, the guillotine mandrel is coupled to a rig end of the length of tubing via a load mandrel, a top sub and a coupling device.

The guillotine alignment sub may be coupled to the rest of the main body on a well side of the tubing cutting zone. This coupling may be direct attachment of the guillotine alignment sub to the rest of the main body. When the tubing is cut in the tubing cutting zone and the top portion is retrieved from the well, the guillotine mandrel will be retrieved with the top portion of the tubing whilst the guillotine alignment sub will remain downhole. This action of retrieving the top portion of the tubing moves the first and second edges relative to each other to thereby sever the umbilical(s).

The umbilical(s) may be any known cabling provided in a completion string (or other wellbore string) for providing power to downhole equipment, for allowing communication between surface and downhole equipment, and/or for monitoring the equipment downhole. For example, the umbilical(s) may comprises hydraulic conduits, electric cables, fibre optic cables, control lines, auxiliary lines, venting lines, reinforcement elements and any combination thereof. In an embodiment, the umbilical is in the form of a flatpack. These tend to have a substantially oval or rectangular cross-section and may incorporate reinforcement bars.

For example, the flatpack(s) may comprise a SCRAMS® Flatpack (dimension 36 mm×12 mm) which consists of two 8 mm bumper bars and one ¼" hydraulic line and one ¼" electric line which are all encapsulated. Alternatively or additionally, the flatpack(s) may comprise a single hydraulic flatpack (dimension 11 mm×11 mm) consisting of one ¼" hydraulic control line which is encapsulated.

It could be seen that the guillotine alignment sub is for aligning the umbilicals to be cut by the guillotine mandrel. The guillotine alignment sub may be in the form of a collar which provides the first edge that interacts with the second edge to cut the umbilical. The guillotine alignment sub may also incorporate formations that assist with the alignment of the guillotine mandrel as it translates in a longitudinal direction, to resist rotation of the guillotine mandrel. More preferably the guillotine alignment sub comprises a substantially tubular component that joins a well end of the length of tubing to the rest of the wellbore string.

In an embodiment, the guillotine alignment sub may comprise a longitudinal guide (e.g., in the form of a recess or opening) for one or more umbilicals. This helps to accommodate the umbilical(s) beneath the guillotine mandrel and ensure that the umbilical(s) are in the correct position for being severed. The guide of the guillotine alignment sub may comprise the first edge over which an installed umbilical would be positioned. For example, the longitudinal guide may be a channel in the guillotine alignment sub and the first edge may be an end wall of the channel. The depth of the longitudinal guide may be great enough so as to ensure that an installed umbilical does not protrude out from the outer diameter of the guillotine alignment sub when lying within it. This helps to protect the umbilicals. However, the first edge causes the umbilical to protrude (preferably entirely) from the alignment sub so that it is severed as the second edge of the guillotine mandrel passes over the first edge.

The longitudinal guide may be arranged to receive two or more umbilicals. The longitudinal guide may be a single channel which is wide enough to receive more than one umbilical. Alternatively the longitudinal guide may comprise a plurality of channels with radial projections therebetween, wherein each channel is arranged to receive a single umbilical.

In an embodiment, the guillotine alignment sub may comprise several longitudinal guides. Each longitudinal guide may enable the installation of a plurality of umbilicals (for example two (or more) flatpacks if the single recess is of a width which is designed to accept two (or more) flatpacks).

When there are a plurality of longitudinal guides they may be located at equal angles from each other around the circumference of the guillotine alignment sub, for example at 180 degrees if there are two, 120 degrees if there are three. This may ease installation of the downhole umbilical release assembly on the rig. For example, in the case where there are three longitudinal guides at 120 degrees from each other around the circumference of the guillotine alignment sub, the guillotine alignment sub may be arranged to require only a maximum relative rotation of 60 degrees to align it to the downhole tubing or the guillotine mandrel, and to install the umbilicals.

The guillotine mandrel, on its surface which faces the guillotine alignment sub, may be provided with a longitudinal recess, extending to the rig side of the second edge, that is sufficiently deep to accommodate the umbilical(s) underneath the guillotine mandrel. This arrangement also helps to protect this section of the umbilicals during deployment of the string.

The downhole umbilical release assembly may be designed to be attached to, and be part of, a well-bore string, for example, a completion string. The wellbore string may be vertical, horizontal or any angle therebetween.

In a second aspect, there is provided a method of severing an umbilical using the downhole umbilical release assembly of the first aspect.

In a third aspect, there is provided a method of severing an umbilical in a downhole umbilical release assembly, wherein the umbilical, which is installed over a first edge of a guillotine alignment sub, is severed by a second edge provided on a guillotine mandrel when the guillotine mandrel is translated in a longitudinal direction with respect to the guillotine alignment sub.

This provides a simple and reliable method of cutting an umbilical in a downhole umbilical release assembly.

The downhole umbilical release assembly may comprise a main body, which in use provides a section of a wellbore string and the main body may comprise a length of tubing having a tubing cutting zone. With this arrangement the method may comprise cutting the tubing in the cutting zone to create a cut, and extracting the portion of the tubing on the rig side of the cut, wherein the guillotine mandrel is arranged so that when the tubing on the rig side of the cut is extracted, the guillotine mandrel is translated in a longitudinal direction with respect to the guillotine alignment sub.

In a fourth aspect there is provided a method of setting up a downhole umbilical release assembly, the method comprising, providing a length of tubing, the tubing having a designated cutting zone; attaching a guillotine alignment sub to one end of the length of tubing, the guillotine alignment sub having a first edge over which an installed umbilical would be positioned; and providing a guillotine mandrel for fitting over the guillotine alignment sub, the guillotine mandrel being configured to slide longitudinally over the guillotine alignment sub during removal of a cut section of the tubing, wherein the guillotine mandrel has been formed with a second edge for drawing over the first edge of the guillotine alignment sub to sever an umbilical installed between the first and second edges.

The method may further comprise securing a load mandrel at the other end of the length of tubing such that it is positioned radially outwardly of, and extends longitudinally over, part of the length of tubing. This may involve fitting a top sub to the tubing and securing the load mandrel to the top sub. The method may further comprise installing one or more umbilicals over the first edge of the guillotine alignment sub and clamping the one or more umbilicals in position. Also the method may further comprise securing the guillotine mandrel to the load mandrel, such that the guillotine mandrel is coupled to the length of tubing via the load mandrel.

In a fifth aspect there is provided a method of installing a downhole umbilical release assembly in a wellbore string, particularly a completion string, the method comprising: providing a downhole umbilical release assembly which comprises a length of tubing having a designated cutting zone; a guillotine alignment sub attached to one end of the length of tubing, the guillotine alignment sub having a first edge over which an installed umbilical would be positioned; installing an umbilical over the first edge of the guillotine alignment sub and clamping in place; fitting a guillotine mandrel over the guillotine alignment sub and coupling it to the tubing, the guillotine mandrel being positioned radially outwardly of the guillotine alignment sub and configured to slide longitudinally over the guillotine alignment sub during removal of a cut section of the tubing, wherein the guillotine mandrel has been formed with a second edge for drawing over the first edge of the guillotine alignment sub to sever an umbilical installed between the first and second edge; and attaching the downhole umbilical release assembly to a wellbore string.

In an embodiment, the method may comprise securing a load mandrel at the other end of the length of tubing such that it is positioned radially outwardly of, and extends longitudinally over, part of the length of tubing. This may involve fitting a top sub to the tubing and securing the load mandrel to the top sub. The method may further include securing the guillotine mandrel to the load mandrel to couple it to the tubing.

Any of the features, including any of the preferable or optional features, of the first to fifth aspects are applicable to any of the other aspects of the invention even if not explicitly recited together.

BRIEF DESCRIPTION OF THE DRAWINGS

Certain preferred embodiments of the present invention will now be described by way of example only and with reference to the accompanying drawings, in which.

DETAILED DESCRIPTION

In the figures, reference is made to the downhole umbilical release assembly being used with a completion string. It is also envisaged that the downhole umbilical release assembly may have application in other forms of wellbore string where one or more umbilicals may be present together with tubing and at times the umbilical need releasing. The following example should therefore be read as applying equally to any such wellbore string.

Figure 8:
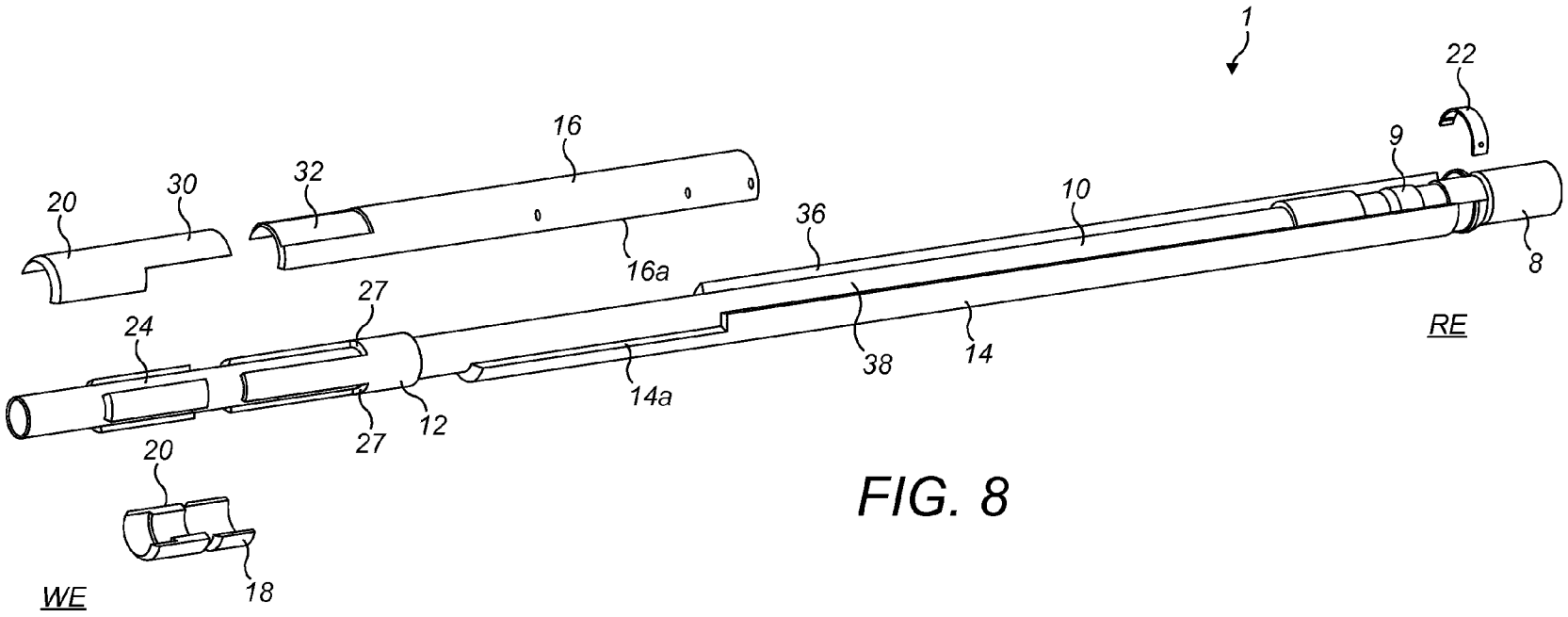
FIG. 8 shows a partially exploded view of another exemplary embodiment of a downhole umbilical release assembly.

FIGS. 1 to 7 show an embodiment of a downhole umbilical release assembly 1 which is designed to be a part of a well-bore completion string (not shown). FIG. 8 shows a further embodiment of a downhole umbilical release assembly 1 which incorporates some alternative features. Like parts in the embodiments are labelled with the same reference numerals and the passages below in relation to the first described embodiment apply equally to the second described embodiment of FIG. 8, and vice versa.

The downhole umbilical release assembly 1 (which will be referred to from now on as "DURA 1") comprises three main sections: the main body 2, an outer section or assembly 4 and an umbilical entry area 6.

The main body 2 is designed to be connected to, and be part of the completion string. This part bears all the production string loads. The main body 2 comprises three main components: a top sub 8, a length of production tubing 10 having a production tubing cutting zone and guillotine alignment sub 12. The top sub 8 is connected to the length of production tubing 10 via a coupling means 9. This main body 2 also comprises additional rated tubing components which include premium tubing connections (not shown).

Figure 1:
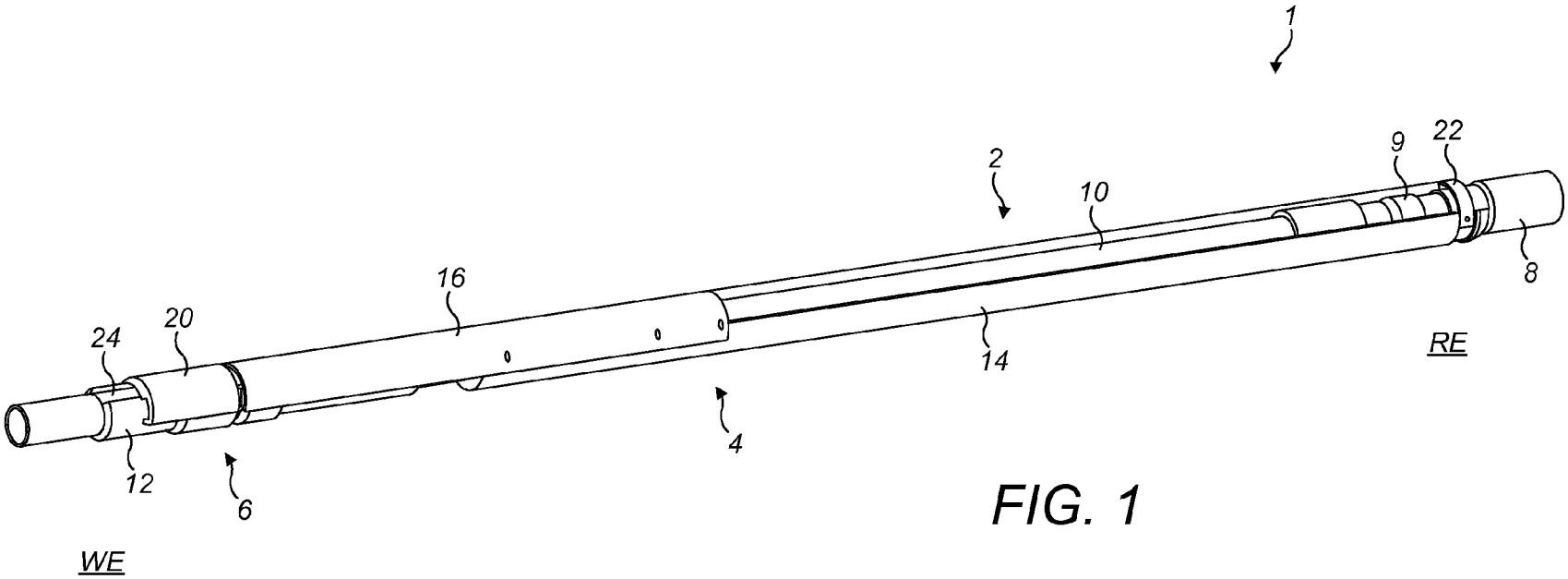
FIG. 1 is a perspective view of an exemplary embodiment of a downhole umbilical release assembly.
Figure 2:
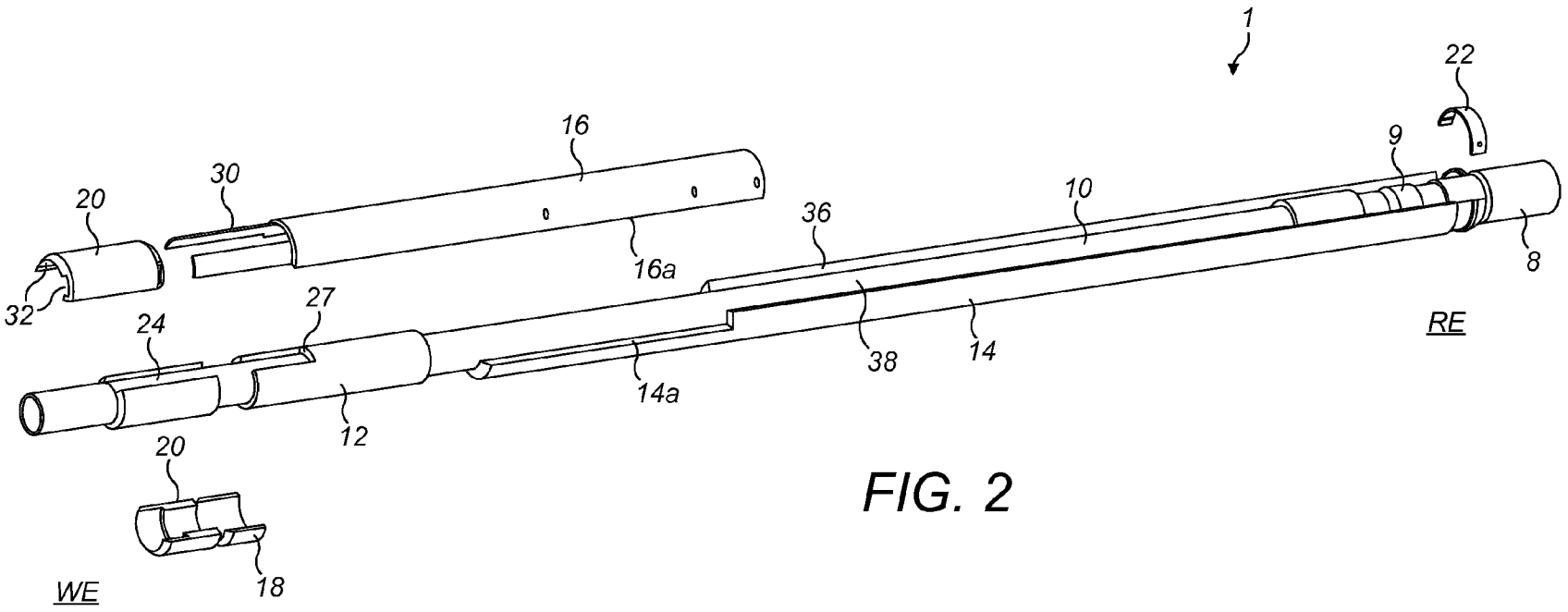
FIG. 2 is a partially exploded view of the downhole umbilical release assembly of FIG. 1.
Figure 3:
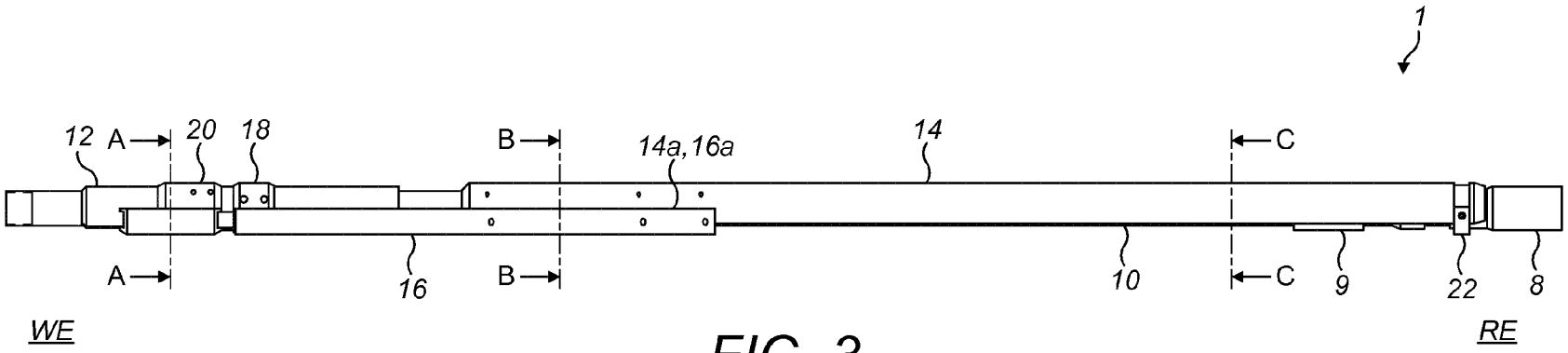
FIG. 3 is a side view of the downhole umbilical release assembly of FIG. 1 with the positions of the sections of FIGS. 4A to 4C shown.

The outer assembly 4 comprises two main components, namely a load mandrel 14 and guillotine mandrel 16. These are shown separated in the exploded view of FIG. 2 but in use are joined along longitudinally extending surfaces 14*a* and 16*a* as can be seen in FIG. 3. The outer assembly 4 is connected to the tubing string via the top sub 8. The outer assembly 4 may also comprise a guillotine mandrel support clamp 18 indicated in FIG. 2, which holds the outer assembly 4, and more particularly the guillotine mandrel 16, in position relative to the main body 2. The outer assembly 4 in part provides part of an umbilical protection system. A section of an umbilical(s) 5 which is installed in the DURA 1 will be covered by the guillotine mandrel 16 and another section is received in a slot provided in the load mandrel 14. The assembly may accommodate one, two or more than two umbilicals 5. In the embodiment shown the DURA 1 is arranged to accommodate two umbilicals 5.

Figure 4C:
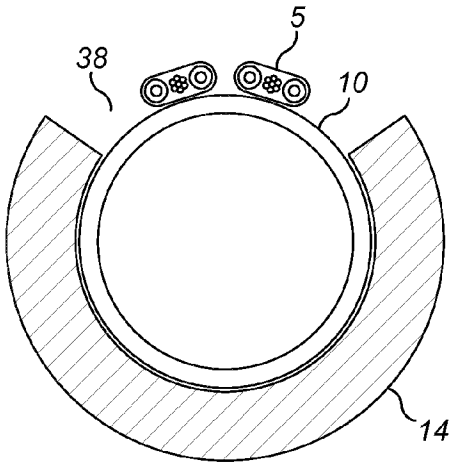
FIGS. 4A to C show selected sections of the downhole umbilical release assembly of FIG. 3.
Figure 4B:
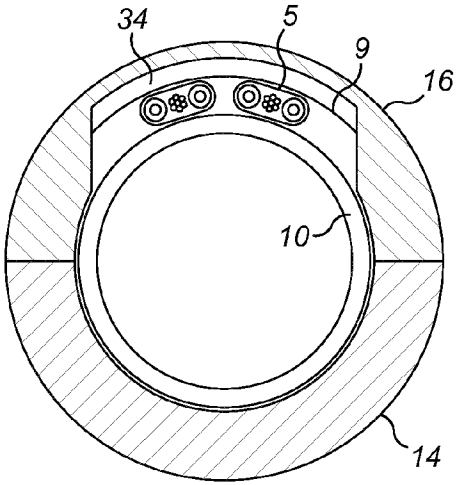
Figure 4A:
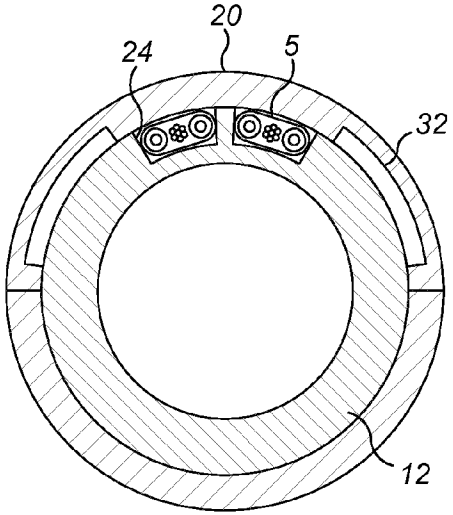

The umbilicals 5 can be seen in more detail in FIGS. 4A to 4C, and are of a form that is often referred to as a "flatpack" comprising a plurality of control lines, hydraulic lines, etc. They have a flatter form than the more traditional cylindrical umbilicals, though of course, the DURA 1 can be used with any form of umbilical 5 and is not limited to flatpacks.

The umbilical entry area 6 is provided at a well end of the DURA 1 in the region of the guillotine alignment sub 12. (In FIG. 1 the left-hand side of the DURA 1 is termed the well end (WE) of the downhole umbilical release assembly being closest to the well in use, and the right-hand side of the DURA 1 is termed the rig end (RE) of the downhole umbilical release assembly being closest to the rig in use). The umbilical entry area 6 comprises a guide clamp assembly 20.

The DURA 1 also comprises an umbilical support strap 22 which is for holding the umbilical(s) 5 to the rig side of the main body 2.

To set up the downhole umbilical release assembly 1, first the length of production tubing 10 is provided. The top sub 8 is coupled to the length of the production tubing 10 via the coupling device 9. The guillotine alignment sub 12 is attached to the length of production tubing 10 at the well end (WE). The load mandrel 14 is fitted to the top sub 8, coupling it to the length of production tubing 10. These steps can all be completed offsite to save installation time on the rig. Finally, the guillotine mandrel 16, guillotine mandrel support clamp 18, guide clamp assembly 20 and the umbilical support strap 22 are provided for attachment to the partially-assembled DURA 1 onsite once the umbilical(s) 5 have been installed.

To install the DURA 1, the length of production tubing 10 of the above described partially-assembled DURA 1, set up as described, is connected to a downhole production tubing (not shown) via the guillotine alignment sub 12. The umbilicals 5 (not shown in FIGS. 1 and 2, but can be seen in the sectional views of FIGS. 4A to 4C) are then located over the guillotine alignment sub 12, firstly along a groove 24 (see the section A-A of FIG. 3 shown in FIG. 4A) to a point where the umbilicals 5 would be severed, over an outer surface of the guillotine alignment sub 12 where it is enclosed within a recess 34 of the guillotine mandrel 16 from the point where the umbilicals would be severed (see section B-B of FIG. 3 shown in FIG. 4B, and also FIGS. 6 and 7 where this recess 34 can be seen more clearly), and then up through a longitudinally extending slot 38 provided in the load mandrel 14 (see section C-C of FIG. 3 shown in FIG. 4C which is looking back down the slot 38 towards the well end (WE)). The umbilicals 5 are clamped in place to the assembly 1 at the well end by the guide clamp assembly 20 and at the rig end by the umbilical support strap 22. The guillotine mandrel 16 is then placed over the umbilicals 5 and attached (for example, by threaded fasteners such as screws or bolts) to the load mandrel 14 along longitudinally extending surfaces 14*a*, 16*a*, such that it lies radially outwardly of the guillotine alignment sub 12. The guillotine mandrel 16 is then clamped in position by the guillotine mandrel support clamp 18.

In certain circumstances it may be required to cut and retrieve a portion of the production tubing 10. When this is done it is necessary to sever the umbilicals 5 so that the cut portion can be removed from the well. The severing of the umbilicals 5 will now be described.

Firstly, the production tubing 10 is cut in its cutting zone by a standard internal tubing cutting device (not shown).

During the cutting of the production tubing 10, the casing wall of the well is protected by the outer assembly 4, in particular by the wall of the load mandrel 14. The DURA 1 provides a long cut zone, typically between 1 and 9 meters, preferably between 3 and 7 meters, more preferably around 5 meters long. Such a long zone for the cutting allows the tubing cutting device to be positioned safely without problems.

Once the length of production tubing 1 has been cut, the tubing cutting device is pulled out of the wellbore. The entire tubing string is then pulled out. At this point, the available pulling force draws up the outer assembly 4 which is locked to the tubing string via the top sub 8.

The cutting of the umbilicals 5 is achieved by longitudinal translation of the guillotine mandrel 16 relative to the guillotine alignment sub 12 (as will be explained in more detail below) as the upper components are lifted out of the well.

Figure 5:
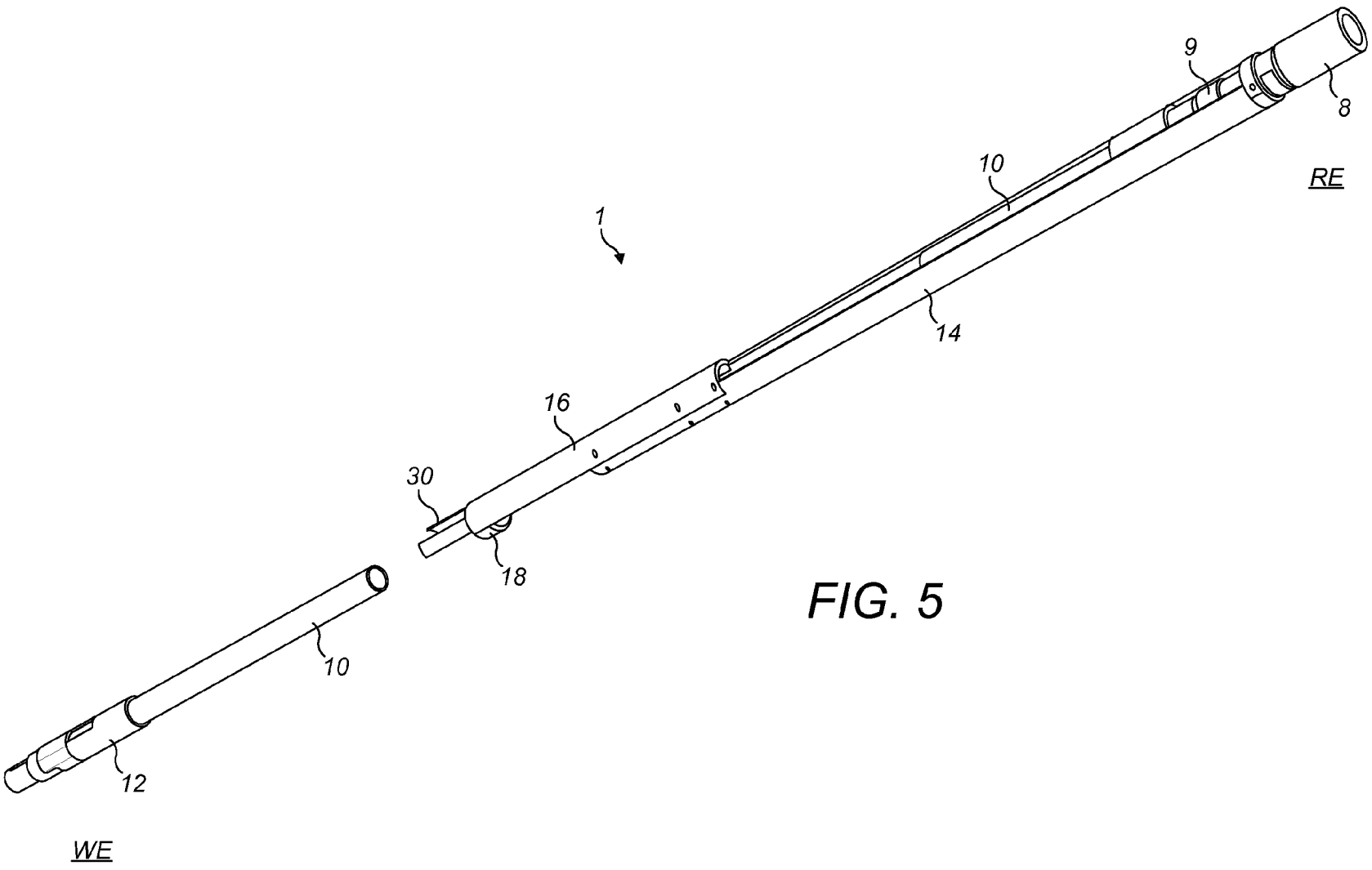
FIG. 5 is a perspective view showing the downhole umbilical release assembly of FIG. 1 once the umbilical has been severed and the outer assembly has been pulled away from the main body.
Figure 6:
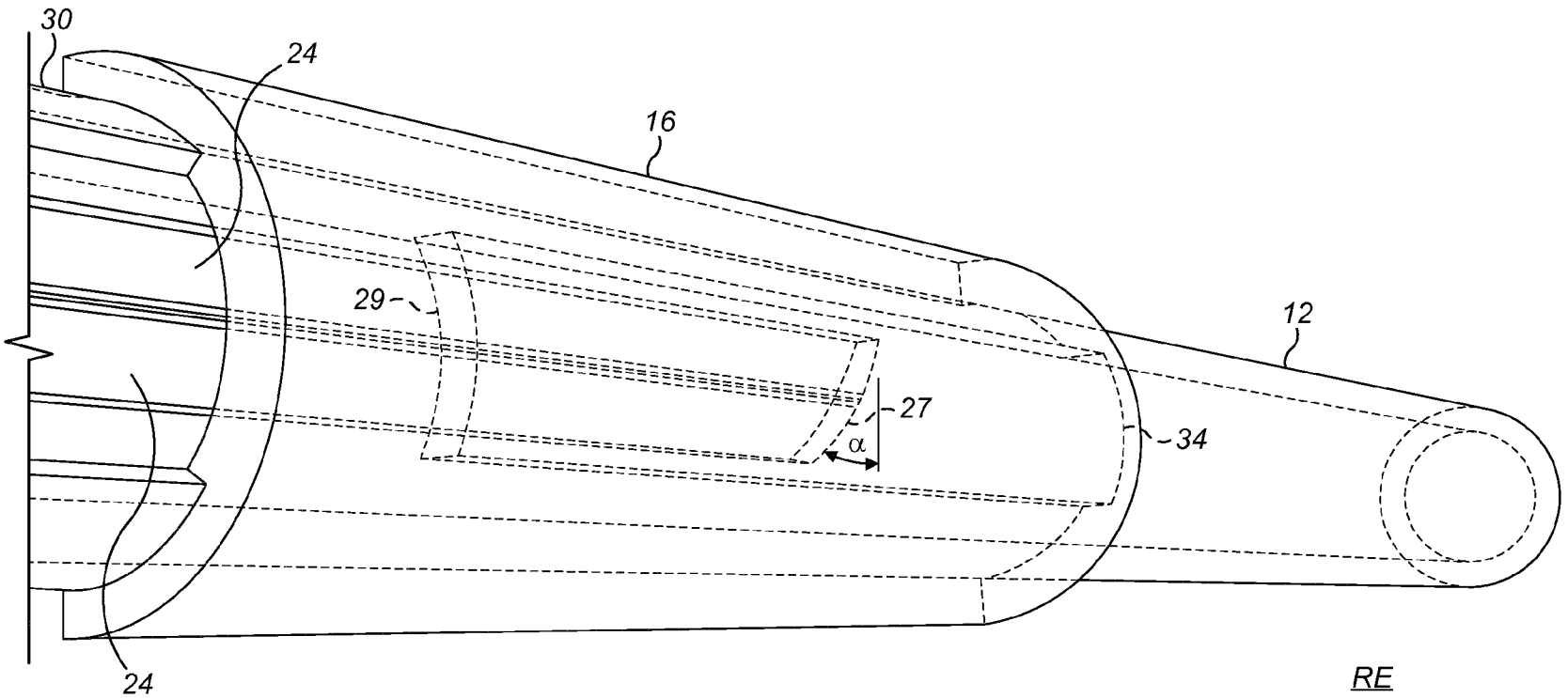
FIG. 6 is a perspective view and enlargement showing a preferred configuration of the first and second edges of the guillotine mandrel and the guillotine alignment sub.
Figure 7:
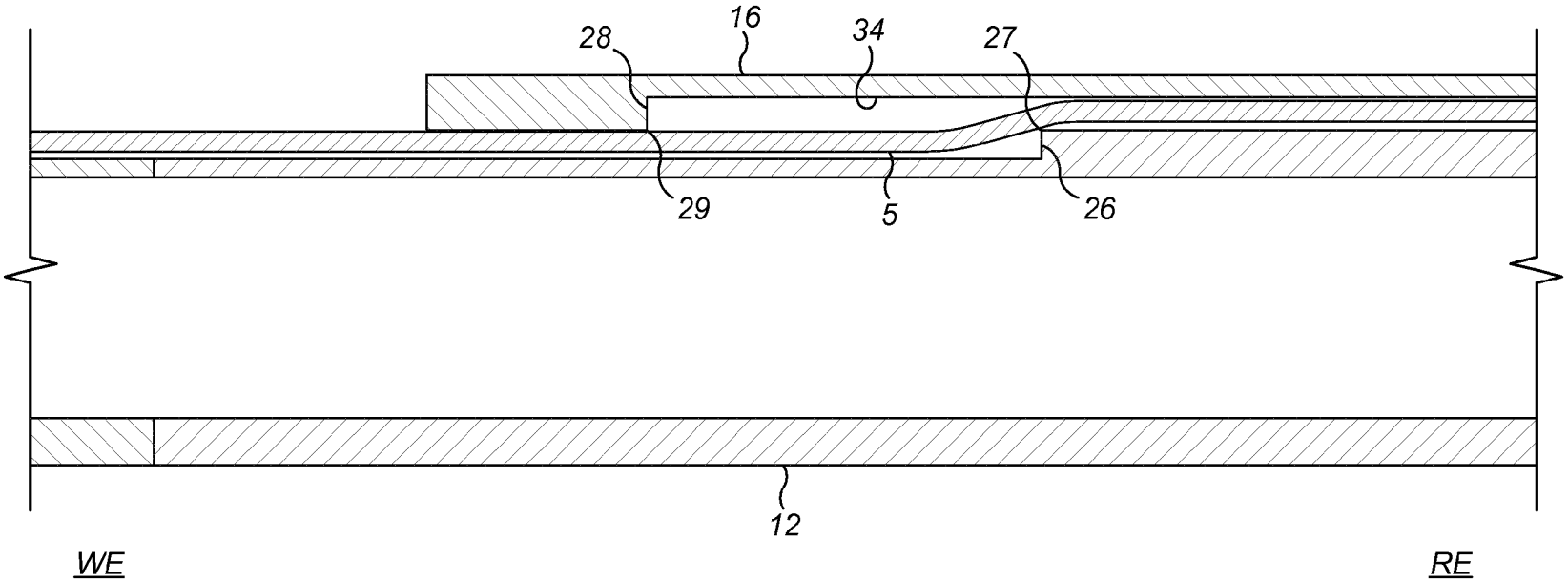
FIG. 7 shows an enlarged cross section of the umbilical cutting zone.

The outer assembly 4, i.e., the load mandrel 14 and the guillotine mandrel 16, together with the top sub 8, the guillotine mandrel support clamp 18 and the upper part of the production tubing (the section of the tubing that was on the rig side of the cut point), and the upper section of the severed umbilicals 5, which are held by the umbilical support strap 22, are all retrieved topside through being connected to the tubing string. FIG. 5 shows how these two parts of the DURA 1 separate from one another as the upper part of the production tubing is retrieved topside.

The parts of the assembly remaining downhole after withdrawal of the tubing string are the guillotine alignment sub 12, the guide clamp assembly 20, the lower part of the production tubing (the section of the tubing on the well side of the cut point) and the lower section of the umbilicals which have been severed at a point that is below the cut point and hence below the lower section of the cut zone tubing.

After pulling the production tubing, the well situation is a clean stick up of blank production tubing allowing standard overshot tools for further well entry.

The severing of the umbilicals 5 will now be described in more detail.

The umbilicals 5 are attached to the periphery of production tubing via dedicated tubing clamps located below the umbilical cutting assembly (not shown) and connected through the DURA 1 at the guillotine alignment sub 12. In the lower part of the guillotine alignment sub 12 (see FIG. 2) there is provided a longitudinal groove 24, which can be formed by machining the guillotine alignment sub 12. The umbilicals 5 are installed so that they lie in this longitudinal groove 24 of the guillotine alignment sub 12. The depth of the groove 24 is such that the umbilicals 5 do not protrude out of the guillotine alignment sub 12, i.e., the groove 24 is deeper than the thickness of the umbilicals 5. The umbilicals 5 exit the groove 24 over a dog-leg 26 (see FIG. 7), and are then located over the outer surface of the guillotine alignment sub 12. At this point of the 'dog-leg' 26, the umbilicals 5 protrude from the outer diameter of the guillotine alignment sub 12. The dog-leg 26 provides a first edge 27 of the guillotine arrangement that is used to sever the umbilicals 5.

The guillotine alignment sub 12 is partially covered by the guillotine mandrel 16 at the level of the longitudinal groove 24. The guillotine mandrel 16 preferably does not surround (circumferentially) the guillotine alignment sub 12, but covers only a limited circular extent, with an angle in a range generally comprising 90-180 degrees (±10 degrees), preferably 120-180 degrees (±10 degrees), and most preferably about 180 degrees (±10 degrees). The guillotine mandrel 16 is connected with the load mandrel 14, and is centred around the production tubing 10. The guillotine mandrel 16 comprises on its underside an internal shoulder 28 that provides a second edge 29 of the guillotine arrangement. It may be sharper than the first edge 27 of the guillotine alignment sub 12. The shoulder 28 preferably has an angle when viewed in cross section of close to 90 degrees, but the angle can be acute and down to 45 degrees, though more preferably would be steeper than 60 degrees, e.g., 80 to 90 degrees (±10 degrees).

The guillotine mandrel 16 internal diameter at the second edge 29 is precisely dimensioned so as to be able to slide against the outer diameter of the guillotine alignment sub 12. Thus, when the tubing string is pulled out, entraining the guillotine mandrel 16 which is connected to the load mandrel 14, itself connected to the top sub 8, the guillotine arrangement of the first and second edges 27,29 passing over one another will chop the umbilicals 5 where they protrude at the dog-leg 26 on the guillotine alignment sub 12.

In order to ensure correct positioning of the second edge 29 with respect to the first edge 27 at the dog-leg 26, the lower end of the guillotine mandrel 16 comprises a guide part, and in particular a pair of wings 30 which are enclosed in and guided by slots 32 in the guide clamp assembly 20. The length of the wings 30 is such that, while the guillotine mandrel 16 is translated longitudinally with respect to the guillotine alignment sub 12 once cutting of the production tubing 10 has been completed, the wings 30 are gradually drawn out from the slots 32 of the guide clamp assembly 20 but are still retained by them as the second edge 29 meets the dog-leg 26 and passes over the first edge 27. Once the cutting of the umbilicals 5 is complete, the wings 30 are withdrawn completely from the slots 32 of the guide clamp assembly 20. The position of the guillotine mandrel 16 relative to the guillotine alignment sub 12 is also guided by the guillotine mandrel support clamp 18 to help make sure that any deflection of these parts is minimal.

Additionally or alternatively, the guide clamp assembly 20 may comprise a guide formation which is received in a guide slot on an outer or inner surface of the guillotine mandrel 16. FIG. 8, for example, shows an embodiment where a guide member in the form of a single projection or wing 30 extends from the guide clamp assembly 20 towards the rig end (RE) of the DURA 1. The wing 30 is received in a slot 32 provided on the outer surface of the guillotine mandrel 16. This arrangement has advantages in terms of being easier to machine as well as providing alignment support close to the region where the umbilicals 5 are being cut. The wing 3 and slot 32 are preferably of a length that maintains the alignment of the guillotine mandrel 16 with respect to the guillotine alignment sub 12 until after cutting has taken place (i.e., until after the second edge 29 has passed over the first edge 27, taking into account stretch in the umblical 5 during the cutting operation, which might, for example, be up to 10, 15 or 20 cm depending on the cutting arrangement and umblicals concerned).

The first edge of the guillotine arrangement, provided by the end of the longitudinal groove 24 where the guillotine alignment sub 12 forms a dog-leg 26, advantageously presents an acute angle $\alpha$ relative to the transverse or circumferential direction. The assembly shown comprises two channels in the longitudinal groove 24, for accommodating two umbilicals 5 with a radial projection therebetween. By providing the first edge at an angle $\alpha$ such that it is inclined with respect to the longitudinal direction, the second edge 29 of the guillotine mandrel 16, which extends in a transverse or circumferential direction (e.g., at roughly 90 degrees to the longitudinal direction) will cut the umbilicals sequentially. This reduces the maximum force required to cut the umbilicals 5 and prevents significant spring back occurring when they are released. The angle $\alpha$ may be between 20 and 85 degrees, preferably between 30 and 60 degrees, and most preferably around 45 degrees. Another preferred embodiment has a up to 45 degrees, more preferably between 15 and 30 degrees, and most preferably around 22.5 degrees (e.g., ±5 degrees). The angle can be optimised as a function of the width of the umbilicals. The optimal angle may depend on whether it is desired to minimise cutting force or provide a clean cut of the umbilical(s) which is performed over a shorter distance. The first edge 27 may be provided at a smaller angle $\alpha$ where the second edge 29 on the guillotine mandrel 16 is inclined in the opposite direction to the longitudinal axis, such that the enclosed angle between the two edges is less than 45 degrees, e.g., between 15 and 30 degrees, preferably around 22.5 degrees (±5 degrees).

Embodiments are also envisaged (see for example, FIG. 8) where the guillotine alignment sub 12 is formed with one or more additional sets of longitudinal groove(s) 24 and first edge(s) 27 of the guillotine at other angular positions around the guillotine alignment sub 12. For example, there might be two, three or four such sets of groove(s) 24 and first edge(s) 27. These additional sets can assist with ease of installation of the umbilicals since it requires less rotation of the tubing 10 during installation of the DURA. In one preferred embodiment, the DURA comprises three sets of groove(s) 24 and first edge(s) 27, each orientated at 120 degrees to the next.

The umbilical cutting assembly 1, at least as described in the above preferred embodiments, provides a simple and compact solution for cutting umbilicals 5. For a 5½ inch (140 mm) production tubing, the largest outer diameter of the tool can be as low as 8.2 inches (208 mm), which allows the assembly to be installed in a well with 9⅝ inch (245 mm) casing.

During assembly, and during production, the umbilicals 5 on the assembly 1 are totally protected along the underside of the guillotine mandrel 16 within the recess 34, and partly protected by the flanks 36 of the load mandrel 14 either side of the slot 38. The load mandrel 14 forms a circular protector for the outer casing of the well (not shown) from damage during cutting of the production tubing 10 over an angle range of 180 to 345 degrees, more preferably 270-330 degrees, most preferably 290-310 degrees. The load mandrel may also be a closed cylinder, i.e., a protector that extends a full 360 degrees angle, which is provided with groove(s) in which to clamp the umbilical(s).

This downhole umbilical release assembly 1, at least in the described preferred embodiments, present a number of advantages.

The umbilical(s) 5 can be installed very quickly while the DURA 1 is being installed on the tubing line on the deck. An installation time of about 10 to 30 min is expected.

The DURA 1 can be installed at any place on the tubing string; it does not require termination of the umbilicals 5.

It is very robust since it is made of few moving parts

The mechanism for severing the umbilical(s) is simple, and there is no rotation involved: dirt will not risk jamming the mechanism and thus the assembly is reliable.

The design is flexible and can accommodate one or more umbilicals whilst remaining compact.

The cutting part of the assembly (the guillotine mandrel 16) is collected back topside after severing the umbilical(s).

The load applied when pulling the production string/completion out of the well, has a direct impact on the guillotine action of the first and second edges. No tension specifically on the flatpacks is required to sever them.

In summary, this preferred DURA 1 is easy to install as part of the production tubing during deployment, does not compromise integrity of the system, eliminates the potential risk of casing damage due to cutting, allows for a safer five meter cutting zone of production tubing and allows precise control of the position where the umbilical cut occurs, and is robust and reliable.

EXAMPLE

A downhole umbilical release assembly according to a preferred embodiment of the invention has been tested with three different cutting configurations of the first and second edges.

The guillotine alignment sub was fitted with two SCRAMS® Flatpacks (dimension 36 mm×12 mm) consisting of two 8 mm bumper bars and one ¼" hydraulic line and one ¼" electric line which are all encapsulated and a single hydraulic Flatpack (dimension 11 mm×11 mm) consisting of one ¼" hydraulic control line encapsulated.

The three different configurations tested were as follows:

1) The first cutting edge had a square shoulder (90 degrees) and had a relative cutting angle $\alpha$ to the second cutting edge of 15 degrees,
2) The first cutting edge had a square shoulder (90 degrees) and had a relative cutting angle $\alpha$ to the second cutting edge of 30 degrees, and
3) The first cutting edge had 30 degree shoulder and a relative cutting angle $\alpha$ to the second cutting edge of 30 degrees. The results of the tests are shown below:

| Position (Cutting Angle/ Shoulder | Flatpack Description | Shear Force (Tons) | Stretch Measure at Top (cm) | Stretch Measure at Bottom (cm) | Travel Distance between Guillotine Mandrel and Clamp (cm) |
|---|---|---|---|---|---|
| 1 | SCRAMS 1 | 8.9 | 2.3 | 2.2 | 7.3 |
| (15/90) | SCRAMS 2 | 9.9 | 3.0 | 2.2 | |
| | Hydraulic Flatpack | 5.5 | 2.3 | 3.4 | |
| 2 | SCRAMS 1 | 6.5 | 3.5 | 2.0 | 10.5 |
| (30/90) | SCRAMS 2 | 6.8 | 5.0 | 2.0 | |
| | Hydraulic Flatpack | 5.5 | 11.0 | 3.5 | |
| 3 | SCRAMS 1 | Not cut (17) | 2.0 | 8.0 | 15.4 |
| (30/30) | SCRAMS 2 | Not cut (17) | 2.0 | 10.0 | |
| | Hydraulic Flatpack | Cut | 11.0 | 10.0 | |

Testing has shown that the optimum configuration for cutting the flatpacks will depend on what is the most critical parameter; shear force required to cut or travel distance when cutting. Arrangement 1 resulted in the minimum flatpack stretch while the force required for cutting was 45% higher than arrangement 2. Conversely arrangement 2 required 44% more travel between the guillotine mandrel and clamp than arrangement 1. Arrangement 3 showed that for some types of flatpack, a steeper second cutting edge is needed.

The invention claimed is:

1. A downhole umbilical release assembly comprising:

a guillotine alignment sub, the guillotine alignment sub having a first edge over which an installed umbilical would be positioned;

a guillotine mandrel positioned radially outwardly of the guillotine alignment sub and arranged to move longitudinally with respect thereto, the guillotine mandrel comprising a second edge that is arranged to pass over the first edge of the guillotine alignment sub during longitudinal movement of the guillotine mandrel relative to the guillotine alignment sub to sever an installed umbilical; and a main body, which in use provides a section of wellbore string, the main body comprising a length of at least one from the group consisting of production tubing and drilling tubing having a tubing cutting zone.

2. The assembly as claimed in claim 1, wherein the first edge and the second edge are angled with respect to each other.

3. The assembly as claimed in claim 1, wherein the assembly comprises a guide clamp assembly which is arranged to clamp a well end of the umbilical in position.

4. The assembly as claimed in claim 3, wherein the guide clamp assembly is arranged to clamp the umbilical to the guillotine alignment sub on a well side of the first edge.

5. The assembly as claimed in claim 1, wherein the guillotine mandrel is joined to a load mandrel to provide an outer assembly that can be moved longitudinally with respect to the guillotine alignment sub.

6. The assembly as claimed in claim 1, wherein the guillotine mandrel is coupled to the main body on a rig side of the tubing cutting zone.

7. The assembly as claimed in claim 1, wherein the guillotine alignment sub is coupled to the main body on a well side of the tubing cutting zone.

8. The assembly as claimed in claim 1, wherein the main body comprises a top sub which is attached to the length of tubing at a rig end.

9. The assembly as claimed in claim 8, wherein the load mandrel is attached to the top sub.

10. The assembly as claimed in claim 1, wherein the guillotine alignment sub comprises a longitudinal guide for the umbilical, the guide having the first edge over which the installed umbilical would be positioned.

11. A downhole umbilical release assembly comprising:

a guillotine alignment sub, the guillotine alignment sub having a first edge over which an installed umbilical would be positioned;

a guillotine mandrel positioned radially outwardly of the guillotine alignment sub and arranged to move longitudinally with respect thereto, the guillotine mandrel comprising a second edge that is arranged to pass over the first edge of the guillotine alignment sub during longitudinal movement of the guillotine mandrel relative to the guillotine alignment sub to sever an installed umbilical;

wherein the assembly comprises a guide clamp assembly which is arranged to clamp a well end of the umbilical in position; and wherein the guide clamp assembly comprises guide formations which guide the longitudinal movement of the guillotine mandrel relative to the guillotine alignment sub.

12. The assembly as claimed in claim 11, wherein the guide formations comprise:

a guide slot in at least one of the guide clamp assembly and the guillotine mandrel for guiding the longitudinal movement of the guillotine mandrel; and a guide part on the other of the guide clamp assembly and the guillotine mandrel which extends longitudinally and is arranged to be received by the guide slot.

13. A downhole umbilical release assembly comprising:

a guillotine alignment sub, the guillotine alignment sub having a first edge over which an installed umbilical would be positioned;

a guillotine mandrel positioned radially outwardly of the guillotine alignment sub and arranged to move longitudinally with respect thereto, the guillotine mandrel comprising a second edge that is arranged to pass over the first edge of the guillotine alignment sub during longitudinal movement of the guillotine mandrel relative to the guillotine alignment sub to sever an installed umbilical;

wherein the guillotine mandrel is joined to a load mandrel to provide an outer assembly that can be moved longitudinally with respect to the guillotine alignment sub; and wherein the load mandrel comprises a longitudinal slot.

14. A method of severing an umbilical in a downhole umbilical release assembly, the umbilical installed over a first edge of a guillotine alignment sub and the assembly comprising a guillotine mandrel positioned radially outwardly of the guillotine alignment sub and a main body, which in use provides a section of wellbore string, the main body comprising a length of at least one from the group consisting of production tubing and drilling tubing having a tubing cutting zone, the method comprising:

cutting the tubing in the tubing cutting zone to create a cut;

extracting a portion of the tubing on a rig side of the cut;

extracting the tubing on the rig side of the cut such that the guillotine mandrel is translated in the longitudinal direction with respect to the guillotine alignment sub; and severing the umbilical by a second edge provided on the guillotine mandrel passing over the first edge of the guillotine alignment sub.

15. A method of setting up a downhole umbilical release assembly, the method comprising:

providing a length of at least one from the group consisting of production tubing and drilling tubing, the at least one from the group consisting of production tubing and drilling tubing having a designated cutting zone;

attaching a guillotine alignment sub to one end of the length of at least one from the group consisting of production tubing and drilling tubing, the guillotine alignment sub having a first edge over which an installed umbilical would be positioned; and providing a guillotine mandrel for fitting over the guillotine alignment sub, the guillotine mandrel being configured to slide longitudinally over the guillotine alignment sub during removal of a cut section of the at least one from the group consisting of production tubing and drilling tubing, wherein the guillotine mandrel includes a second edge for drawing over the first edge of the guillotine alignment sub to sever an umbilical installed between the first and second edges.

16. The method as claimed in claim 15, further comprising securing a load mandrel at the other end of the length of tubing, such that it is positioned radially outwardly of, and extends longitudinally over, part of the length of tubing.

17. The method as claimed in claim 16, further including fitting a top sub to the tubing and securing the load mandrel to the top sub.

18. The method as claimed in claim 15, further comprising installing one or more umbilicals over the first edge of the guillotine alignment sub and clamping the one or more umbilicals in position.

* * * * *